US006263884B1

(12) United States Patent
Minnelli

(10) Patent No.: US 6,263,884 B1
(45) Date of Patent: Jul. 24, 2001

(54) DEVICE FOR BINDING A PONYTAIL HAVING A NATURAL HAIR APPEARANCE

(76) Inventor: Mia Minnelli, 1770 Broadway #101, San Francisco, CA (US) 94109

( * ) Notice: Subject to any disclaimer, the term of this patent is extended or adjusted under 35 U.S.C. 154(b) by 0 days.

(21) Appl. No.: 09/525,601

(22) Filed: Mar. 14, 2000

(51) Int. Cl.[7] ..... A41G 3/00; A45D 8/04; A45D 8/12

(52) U.S. Cl. ..... 132/273; 132/201; 132/275; 132/53

(58) Field of Search ..... 132/273, 53, 55, 132/201, 275

(56) References Cited

U.S. PATENT DOCUMENTS

| | | | | |
|---|---|---|---|---|
| D. 52,258 | * | 8/1918 | Upton | D2/344 |
| D. 59,261 | * | 10/1921 | Muller | D28/41 |
| D. 229,240 | * | 11/1973 | Fox | D2/344 |
| D. 273,341 | * | 4/1984 | Rol | D28/41 |
| D. 273,342 | * | 4/1984 | Rol | D2/344 |
| D. 368,983 | * | 4/1996 | Gruters et al. | D28/41 |
| 1,713,616 | * | 5/1929 | Oppenheim | 132/273 |
| 2,567,119 | * | 9/1951 | Naidor | 132/53 |
| 2,651,310 | * | 9/1953 | Selson | 132/273 |
| 2,847,016 | * | 8/1958 | Rabinowitz | 132/273 |
| 3,000,384 | * | 9/1961 | Piers | 132/273 |
| 4,600,029 | * | 7/1986 | Ueberschaar | 132/53 |
| 4,830,029 | * | 5/1989 | Bird | 132/54 |
| 5,303,724 | * | 4/1994 | Anzivino | 132/278 |
| 5,465,741 | * | 11/1995 | Dvorak | 132/275 |
| 5,501,239 | * | 3/1996 | Walker | 132/275 |
| 5,551,452 | * | 9/1996 | Barlow | 132/54 |
| 5,899,211 | * | 5/1999 | Brown | 132/201 |

* cited by examiner

*Primary Examiner*—John J. Wilson
*Assistant Examiner*—Robyn Kieu Doan
(74) *Attorney, Agent, or Firm*—Goldstein & Canino

(57) ABSTRACT

A ponytail binding system, for use by a person having a ponytail having a ponytail end, using a device comprising synthetic hair fibers joined to an elastic band to form a closed loop. The synthetic hair fibers are joined to the elastic band with a pair of connectors. The ponytail is inserted into the closed loop, and the device is tensioned around the ponytail by twisting the closed loop and inserting the ponytail end into the secondary loop formed thereby. Once the device is suitably tensioned on the ponytail, the synthetic hair fibers are pulled over the elastic band so that the outward appearance of the device is formed solely by the synthetic hair fibers, which are selected so as to blend with the hair of the person.

5 Claims, 2 Drawing Sheets

DEVICE FOR BINDING A PONYTAIL HAVING A NATURAL HAIR APPEARANCE

BACKGROUND OF THE INVENTION

The invention relates to a device for binding a ponytail having a natural hair appearance. More particularly, the invention relates to a device which securely attaches around a ponytail, but which provides the outward appearance of natural hair.

Certain hair styles dictate that a portion of the hair is gathered and grouped into a "ponytail". The most traditional way to gather and group hair is by tying it with a ribbon. However, tying the hair in the ponytail with a ribbon requires coordination and dexterity. In addition, removing the ribbons can be difficult and tedious as one attempts to blindly undo a knot.

Hair clips and elastic bands are also used to gather and bind groups of hair. Hair clips grab the hair between a pair of jaws which are spring-tensioned against one another. The jaws are flexed apart, placed around the hair grouping, and are released to clamp and hold the hair grouping. Elastic bands are generally in the shape of a ring which is stretched over the hair grouping and released to hold the ponytail in place.

The main drawback of hair clips and elastic bands is their unnatural appearance. Although they are available in a variety of colors, decorated with synthetic and precious stones, and even covered in fabrics, they are always noticeable when in the hair.

U.S. Pat. No. 5,899,211 to Brown discloses an apparatus and method for securing a ponytail. Brown uses a device which employs an elastic loop which can secure around a ponytail, and a length of hair which is attached to the elastic loop at one end, but is free at its opposite end.

While these units may be suitable for the particular purpose employed, or for general use, they would not be as suitable for the purposes of the present invention as disclosed hereafter.

SUMMARY OF THE INVENTION

It is an object of the invention to produce a device for binding a ponytail which has a natural hair appearance. Accordingly, the device employs fine fibers which simulate natural human hair.

It is a further object of the invention to provide a device which securely binds a ponytail. Accordingly, the device employs an elastic band which can be tensioned to firmly maintain a ponytail. The elastic band is then hidden by the simulated human hair fibers to maintain a natural appearance.

The invention is a ponytail binding system, for use by a person having a ponytail having a ponytail end, using a device comprising synthetic hair fibers joined to an elastic band to form a closed loop. The synthetic hair fibers are joined to the elastic band with a pair of connectors. The ponytail is inserted into the closed loop, and the device is tensioned around the ponytail by twisting the closed loop and inserting the ponytail end into the secondary loop formed thereby. Once the device is suitably tensioned on the ponytail, the synthetic hair fibers are pulled over the elastic band so that the outward appearance of the device is formed solely by the synthetic hair fibers, which are selected so as to blend with the hair of the person.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 2:
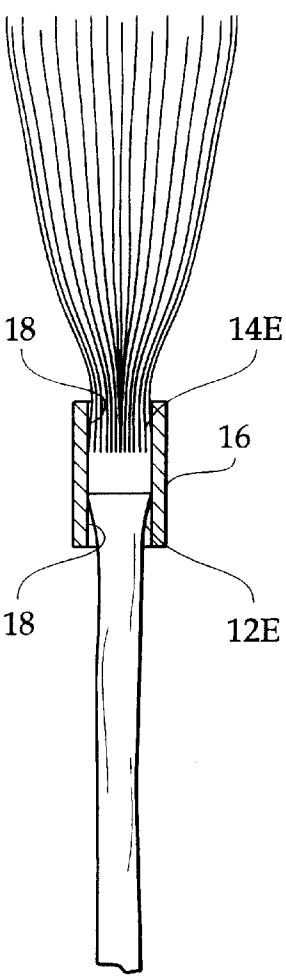
FIG. 2 is a cross sectional view with parts broken away, illustrating one of the two connectors according to the present invention.
Figure 1:
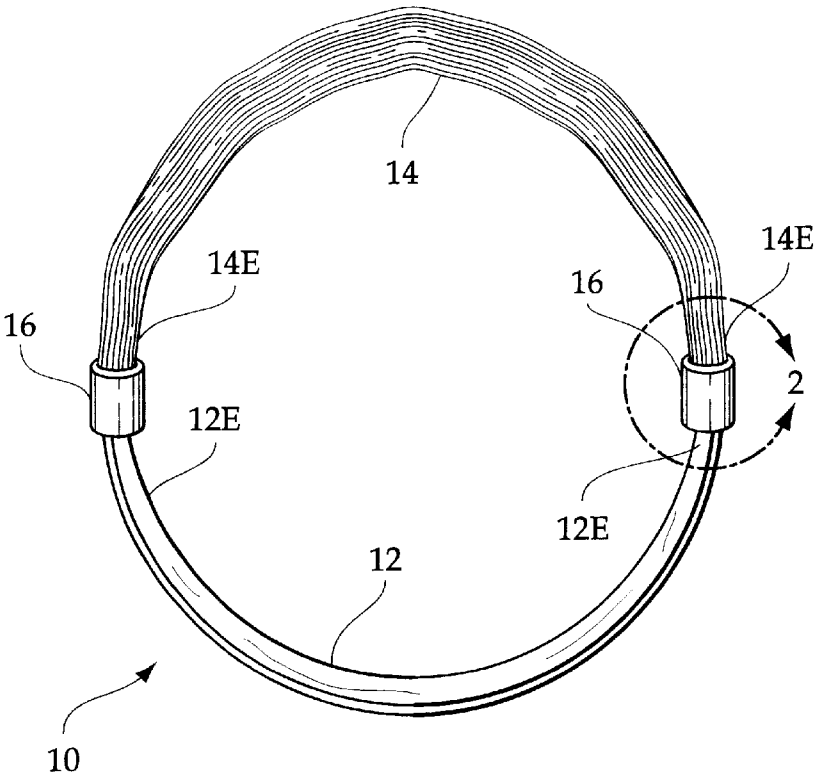
FIG. 1 is a diagrammatic perspective view, illustrating the invention, per se.

FIG. 1 illustrates a device for binding a ponytail 10, comprising an elastic band 12, and a group of synthetic hair fibers 14. The elastic band 12 has a pair of elastic band ends 12E. The synthetic hair fibers 14 are all of substantially the same length, and collectively have a pair of synthetic hair fiber ends 14E. A pair of connectors 16 are used to permanently join each one of the elastic band ends 12E to one of the hair fiber ends 14E. Accordingly, the synthetic hair fibers 14 and elastic band 12S together form a closed loop.

The synthetic hair fibers 14 are made of a material which greatly resembles human hair. Suitable materials are commonly used in wigs, hair extensions, and hair pieces. However, typically these materials resist tensile deformation. In other words, they typically cannot be stretched without breaking.

The elastic band 12 is made of a stretchable material, such as rubber, or the like. The elastic band 12 thus provides the binding device 10 with the necessary elasticity so that it can stretch around a group of hair, and then exert a constricting tension against that group of hair to hold it in place.

Referring to FIG. 1, each connector 16 is a sleeve having a pair of connector open ends 18. One of the elastic band ends 12E is inserted into one of the connector open ends 18, and one of the synthetic hair fiber ends 14E is inserted into the other connector open end 18E. Once inside the connector, the synthetic hair fibers and elastic band are fused therein using heat, adhesives, chemicals, mechanical friction, or any other suitable means. The fibers and elastic band need not be directly fused to one another, since the connector 16 joins them indirectly. As seen in FIG. 1, using two connectors 16 completes the closed loop to form the binding device 10.

Figure 3:
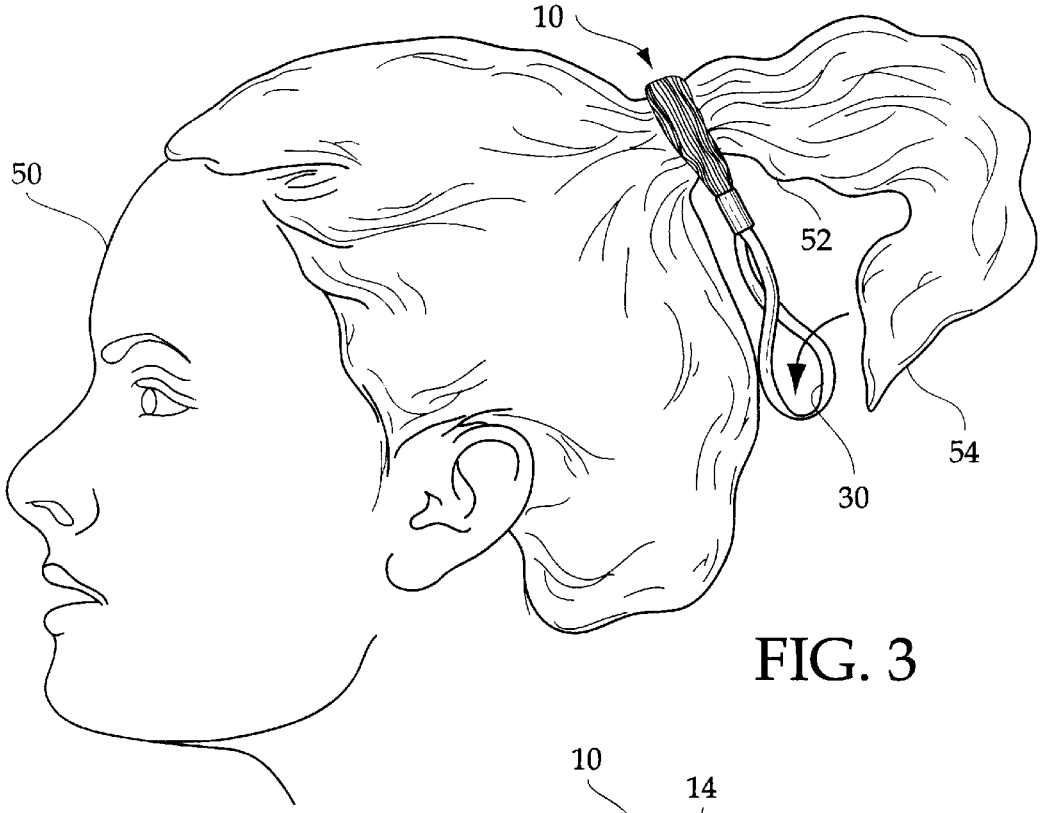
FIG. 3 is a side elevational view, illustrating the invention in use, being used to gather and hold a ponytail.

FIG. 3 illustrates the binding device 10 in use binding the hair of a person 50, having a ponytail 52 having a ponytail end 54. The binding device 10 has been placed over the ponytail 52 by inserting the ponytail end 54 through the closed loop of the binding device 10 so that the binding device 10 fully encircles the ponytail 52. At this point, the closed loop fits loosely over the ponytail 52.

In order to make the binding device 10 fit tightly over the ponytail 52, the binding device 10 is twisted to form a secondary loop 30. Then, the ponytail end 54 is inserted through the secondary loop 30. This doubling up of the binding device 10 causes a tighter fit around the ponytail 52, and is repeated until numerous loops are formed around the ponytail 52 and the binding device 10 fits tightly around the ponytail 52.

When the binding device 10 has been looped around the ponytail 52 numerous times, the elastic band portion thereof becomes stretched and thus tensioned. Since the elastic band portion forms a continuous loop with the less stretchable synthetic hair fibers, the tensioned elastic band acts to pull the synthetic hair fibers tightly around the ponytail 52.

Figure 4:
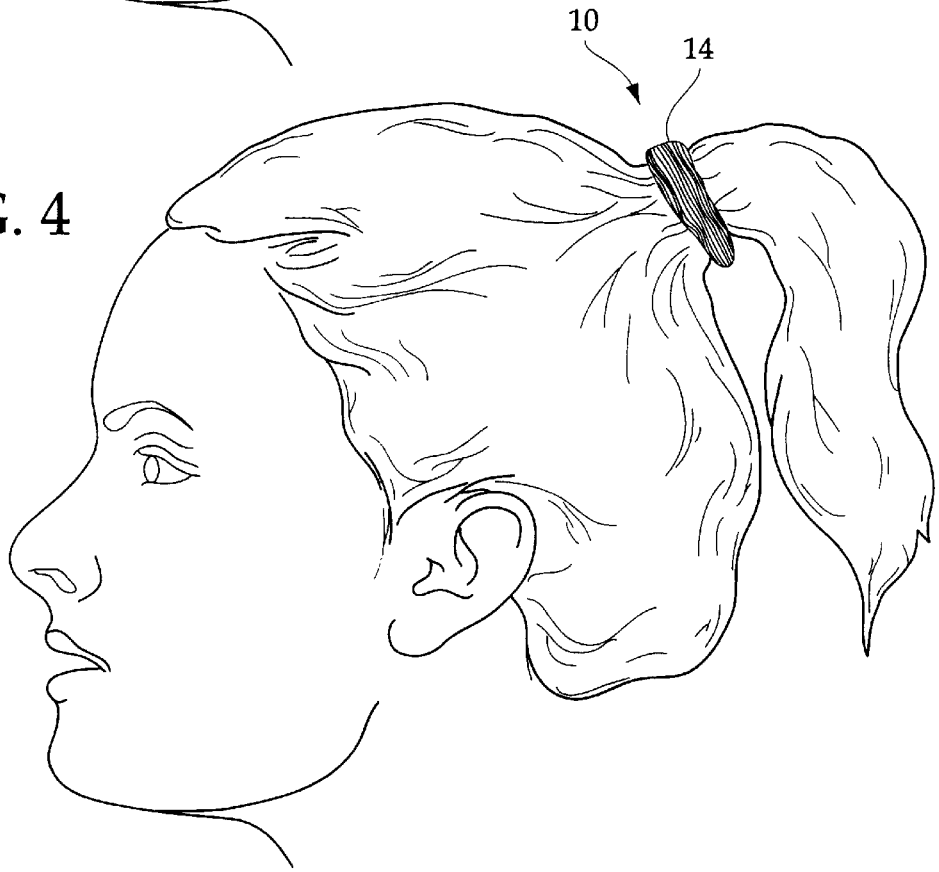
FIG. 4 is a side elevational view, illustrating the invention in use, wherein the ponytail has been gathered, and wherein the elastic band is concealed with the synthetic hair fibers.

Referring now to FIG. 4, once the binding device 10 has been looped or wrapped around the ponytail 52 numerous times, some of the loops consist of the elastic band, and several of which should consist entirely of the synthetic hair fibers 14. Accordingly, the synthetic hair fibers 14 may be pulled over the elastic band to conceal the elastic band and the connectors, so that the outward appearance of the binding device 10 is provided solely by the synthetic hair fibers, as seen in FIG. 4. Accordingly, if the synthetic hair fibers are suitably matched to the hair of the person, the binding device 10 then appears to be part of that person's natural hair.

In conclusion, herein is presented a binding device suitable for maintaining a ponytail, which provides the outward appearance of natural human hair, while tightly binding and maintaining the ponytail.

What is claimed is:

1. A hair binding device, for binding and maintaining a ponytail, comprising:

an elastic band, having a pair of elastic band ends;

synthetic hair fibers, collectively having a pair of synthetic hair fiber ends; and wherein one of the elastic band ends is permanently joined with one of the synthetic hair fiber ends and the other of the elastic band ends is permanently joined with the other of the synthetic fiber ends so that the elastic bands and synthetic hair fibers together form a closed loop.

2. The hair binding device as recited in claim 1, further comprising a pair of connectors, wherein each of the elastic band ends is joined with one of the synthetic hair fiber ends with one of the connectors.

3. The hair binding device as recited in claim 2, wherein each of the connectors comprises a sleeve and has two connector ends, wherein for each connector one of the elastic band ends is secured in one of its connector ends and one of the synthetic hair fiber ends is secured in the other of its connector ends.

4. A hair binding method, for use by a person having a ponytail having a ponytail end, for securing said ponytail, using a device comprising an elastic band having a pair of elastic band ends, synthetic hair fibers having an appearance similar to the ponytail and having a pair of synthetic hair fiber ends, the synthetic hair fiber ends joined to the elastic band ends to form a closed loop, comprising the steps of:

encircling the ponytail with the device by inserting the ponytail end through the closed loop of said device;

tensioning the device around the ponytail by doubling up the device; and covering the elastic band with the synthetic hair fibers so that the outward appearance of the device is formed solely by the synthetic hair fibers.

5. The hair binding method as recited in claim 4, wherein the step of doubling up the device further comprises repeatedly:

twisting the closed loop to form a secondary loop; and inserting the ponytail end through the secondary loop.

* * * * *